US010065195B1

(12) United States Patent
Page

(10) Patent No.: US 10,065,195 B1
(45) Date of Patent: Sep. 4, 2018

(54) APPARATUS AND METHOD FOR HARVESTING VEGETATION BYPRODUCT THROUGH REGULATED FLOW OF CARBON DIOXIDE AND MECHANICAL AGITATION

(71) Applicant: William Stacy Page, Ashland, OR (US)

(72) Inventor: William Stacy Page, Ashland, OR (US)

( * ) Notice: Subject to any disclaimer, the term of this patent is extended or adjusted under 35 U.S.C. 154(b) by 54 days.

(21) Appl. No.: 15/184,941

(22) Filed: Jun. 16, 2016

Related U.S. Application Data

(63) Continuation-in-part of application No. 14/176,949, filed on Feb. 10, 2014, now abandoned.

(60) Provisional application No. 61/852,821, filed on Mar. 22, 2013, provisional application No. 62/295,528, filed on Feb. 16, 2016.

(51) Int. Cl.

| | |
|---|---|
| ***B02C 23/16*** | (2006.01) |
| ***B02C 23/24*** | (2006.01) |
| ***F25D 3/10*** | (2006.01) |
| ***B07B 1/38*** | (2006.01) |

(52) U.S. Cl.
CPC ..... *B02C 23/16* (2013.01); *B02C 23/24* (2013.01); *B07B 1/38* (2013.01); *F25D 3/10* (2013.01); *B02C 2023/165* (2013.01); *B07B 2201/04* (2013.01)

(58) Field of Classification Search
CPC .... B07B 1/00; B07B 1/28; B07B 1/38; B07B 1/46; B07B 2201/04; B01F 11/0261; B02C 15/001; B02C 23/16; B02C 23/24; B02C 23/30; B02C 23/34
USPC ..... 209/235, 260, 309, 315
See application file for complete search history.

(56) References Cited

U.S. PATENT DOCUMENTS

| | | | | |
|---|---|---|---|---|
| 2,029,848 | A | 2/1936 | Wettlaufer | |
| 3,098,037 | A | 7/1963 | Tonjes et al. | |
| 3,315,417 | A | 4/1967 | Roberts | |
| 3,531,946 | A * | 10/1970 | Hart | F25D 3/11 62/332 |
| 4,233,151 | A | 11/1980 | Gundlach | |
| 4,875,999 | A | 10/1989 | Haight | |
| 5,358,121 | A * | 10/1994 | Robak | B07B 4/02 209/137 |
| 5,992,050 | A | 11/1999 | Kemper et al. | |

(Continued)

*Primary Examiner* — Joseph C Rodriguez
*Assistant Examiner* — Kalyanavenkateshware Kumar
(74) *Attorney, Agent, or Firm* — Jerry Haynes Law

(57) ABSTRACT

An apparatus and method for harvesting vegetation material byproduct enables regulated flow of carbon dioxide and mechanical agitation to create flash frozen vegetation material byproduct, followed by selective collection of the byproducts based on size and composition. An apparatus frame and a pivotally mounted extraction assembly mount frame provide structural support. An extraction assembly includes a container that is carried by the extraction assembly mount frame. The container contains the vegetation material. A carbon dioxide vessel contains a carbon dioxide that flash freezes the vegetation material. A conveyor and a size adjustable nozzle regulate flow rate and quantity of carbon dioxide flowing from a carbon dioxide vessel to the container. An agitation motor mechanically engages the flash frozen material in the container. A classifier having a classifier mesh with multiple mesh openings is carried by the container. The classifier segregates the agitated byproduct, which is captured by a collection pan.

19 Claims, 10 Drawing Sheets

(56) References Cited

U.S. PATENT DOCUMENTS

| | | | | |
|---|---|---|---|---|
| 6,581,780 | B1 | 6/2003 | Jakob | |
| 7,781,006 | B2 * | 8/2010 | Brisson, II | A23G 9/06 426/515 |
| 7,892,579 | B2 | 2/2011 | Cao | |
| 2010/0247723 | A1 * | 9/2010 | Rudolph | A23G 9/04 426/329 |

* cited by examiner

APPARATUS AND METHOD FOR HARVESTING VEGETATION BYPRODUCT THROUGH REGULATED FLOW OF CARBON DIOXIDE AND MECHANICAL AGITATION

CROSS REFERENCE OF RELATED APPLICATIONS

This application claims the benefit of U.S. provisional patent application No. 62/295,528, filed Feb. 16, 2016 and entitled "VEGETATION MATERIAL BYPRODUCT ING APPARATUS AND METHOD", which application is incorporated by reference herein in its entirety; and this application is a continuation in part of U.S. Ser. No. 14/176,949, filed on Feb. 14, 2014 entitled "VEGETATION BYPRODUCT EXTRACTION APPARATUS", which in turn claims the benefit of U.S. provisional application No. 61/852,821, filed Mar. 22, 2013 and entitled "SHOCKWAVE HERBAL EXTRACTOR THAT MECHANICALLY SEPARATES OUT OILS FROM THE PLANT TO BE USED FOR MANY PRODUCTS", which provisional application is incorporated by reference herein in its entirety.

FIELD OF THE INVENTION

The present invention relates generally to an apparatus and method for harvesting vegetation material byproduct through regulated flow of carbon dioxide and mechanical agitation. More so, the present invention relates to a vegetation material byproduct harvesting apparatus and method which expeditiously extracts vegetation and other plant byproducts from the vegetation material through a flash freezing and dry mechanical agitation process, and then selectively harvest various byproducts based on size and composition of the byproducts.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, flash freezing refers to the process in various industries whereby objects are frozen in a few hours by subjecting them to cryogenic temperatures, or in direct contact with dry ice (carbon dioxide) or liquid nitrogen at −196° C. (−320.8° F.). Flash (or partial) evaporation is the partial vapor that occurs when a saturated liquid stream undergoes a reduction in pressure by passing through a throttling valve or other throttling device.

It is known that mechanical agitation can be used to separate and break down organic material, such as vegetation. The agitation often occurs through at least one of the following: forcible gyratory motion, reciprocal motion, oscillating motion, centrifugal forces, shaking, scrubbing, sedimentation, sieving, stripping, and sublimation. The use of various centrifugal and mechanical separators has been proposed to perform the separation step in conjunction with a freeze process.

In the art, it is recognized that various processes may be used for extracting herbs, oils and/or other byproducts from plants and other vegetation. These processes may utilize liquids to extract the by-products through implementation of intricate processes using complex equipment, rendering the processes expensive and complicated and requiring long drying periods. An herbal extraction apparatus which expeditiously classifies various plant by-products through a dry mechanical agitation process is needed.

Other proposals have involved harvesting vegetation material byproducts through flash freezing and mechanical agitation. The problem with these gripping devices is that they do not regulate the amount of carbon dioxide used for flash freezing and the mechanical agitation forces. Also, the byproduct is not classified into discrete sizes for more efficient packaging. Even though the above cited vegetation byproduct harvesting systems meet some of the needs of the market, a vegetation material byproduct harvesting apparatus and method which expeditiously extracts vegetation and other plant byproducts from the vegetation material through a flash freezing and dry mechanical agitation process, and then selectively harvest various byproducts based on size and composition of the byproducts is still desired.

SUMMARY

Illustrative embodiments of the disclosure are generally directed to an apparatus and method for harvesting vegetation material byproduct through regulated flow of carbon dioxide and mechanical agitation. The apparatus extracts byproducts from a vegetation material through flash freezing with carbon dioxide and dry mechanical agitation of the vegetation material with a mechanical agitating extraction assembly, followed by selective collection of the vegetation material byproducts based on size and composition.

The flash freezing process with carbon dioxide involves dehydrating the vegetation material to facilitate mechanical separation. The flash freezing process is regulated by controlling the flow rate and quantity of carbon dioxide used for the flash freezing. This controlled manner of flash freezing is useful for accommodating the various types of vegetation material, and thus increase efficiency of the harvesting. Specifically, the flow rate and quantity of carbon dioxide used for flash freezing the vegetation material is regulated.

Similarly, the force used for agitating the vegetation material may also be regulated to accommodate the different structures of vegetation material. The agitation extraction assembly breaks down the consequently brittle vegetation material. The classifier helps segregate the different dimensions and shapes of vegetation material for processing.

The vegetation material byproduct harvesting apparatus includes an apparatus frame for supporting the assembly. A strong supportive structure, such as the apparatus frame is especially important when dealing with controlled release of carbon dioxide gas, mechanical agitation forces that create various torques and forces, and classification of flash frozen vegetation material components into the appropriate collection. An extraction assembly mount frame is pivotally carried by the apparatus frame.

The apparatus further comprises a carbon dioxide vessel that is configured to enable containment of a carbon dioxide. The carbon dioxide vessel releases carbon dioxide for flash freezing the vegetation material. The flash freezing process involves freezing the material and then reducing the surrounding pressure in the carbon dioxide vessel to allow the frozen water in the material to sublimate directly from the solid phase to the gas phase.

Those skilled in the art will recognize that at pressures below 5.13 atmospheres and temperatures below −56.4° C. (−69.5° F.) (the triple point), carbon dioxide changes from a solid to a gas with no intervening liquid form, through this sublimation. Thus, carbon dioxide, and in some embodiments nitrogen, are efficacious for flash freezing the vegetation material. It is however, important to regulate the flow rate and quantity of carbon dioxide to accommodate different types of vegetation material.

The extraction assembly, described above, is configured to mechanically separate the flash frozen vegetation material. The extraction assembly may include a container that is carried by the extraction assembly mount frame, at a first end of the extraction assembly. The container contains the vegetation material. A conveyor carries the carbon dioxide from the carbon dioxide vessel to an inlet aperture of the container.

A size adjustable nozzle may extend from the inlet aperture of the container to directionally carry the carbon dioxide from the conveyor to the vegetation material inside the container in the extraction assembly. The size adjustable nozzle directionally carries the carbon dioxide to the vegetation material inside the container. The size adjustable nozzle is unique in that it is configured to increase or decrease in diameter, depending on the flash freezing requirements for the vegetation material. This allows for adjustability of flow rate and quantity (parts-per-million) of carbon dioxide flowing into the container for flash freezing the vegetation material.

Thus, for denser vegetation material, a greater quantity of carbon dioxide may be displaced into the container. Conversely, for smaller vegetation material, a lesser quantity of carbon dioxide may be displaced into the container. This is possible due to the adjustable dimensions of the size adjustable nozzle and a regulator, such as a valve, that works in conjunction with the size adjustable nozzle to regulate flow rate/displacement rate of carbon dioxide into the container.

An agitation motor mechanically engages the container, generating various agitating forces useful for dislodging the frozen byproduct from the flash frozen vegetation material. Because of the dehydrated, brittle state of the vegetation material caused by the carbon dioxide, the agitation is enhanced. Thus, the carbon dioxide flash freezes the vegetation material, and the agitation motor dislodges the frozen byproduct from the vegetation material.

After breaking down the flash frozen vegetation material, the size classification and collection process begins. At least one classifier is used to segregate the components thereof. The classifier is carried by the container, and may include a classifier mesh with a plurality of mesh openings. Further, a collection pan is carried by the at least one classifier at a second end of the extraction assembly for capturing the segregated parts of the vegetation material.

The apparatus further comprises at least one assembly securing mechanism that engages the container and the collection pan. The at least one assembly securing mechanism releasably secures the collection pan and the at least one classifier on the container. A conveyor may be used to carry the carbon dioxide from the carbon dioxide vessel to the container.

In another aspect, the carbon dioxide vessel comprises a regulator that is configured to regulate the flow of carbon dioxide from the carbon dioxide vessel to the container.

In another aspect, the carbon dioxide vessel also contains nitrogen.

In another aspect, the conveyor comprises a vessel end and a container end.

In another aspect, the container end is configured to threadably engage the inlet aperture of the container.

In another aspect, the conveyor comprises a metal tube.

In another aspect, the container is configured to enable containment of a vegetation material.

In another aspect, the apparatus further comprises an assembly positioning handle 26 carried by the extraction assembly mount frame.

In another aspect, the apparatus further comprises a frame locking mechanism carried by the extraction assembly mount frame and releasably engaging the apparatus frame and a handle trigger carried by the assembly positioning handle and engaging the frame locking mechanism.

In another aspect, the extraction assembly mount frame comprises an extraction assembly support member rotatably carried by the apparatus frame. The container is carried by the extraction assembly support member.

In another aspect, the apparatus further comprises a motor mount plate carried by the extraction assembly support member and a pair of agitation motor mount arms carried by the extraction assembly support member on opposite sides of the motor mount plate. The agitation motor is carried by the motor mount plate and the pair of agitation motor mount arms.

In another aspect, the extraction assembly mount frame comprises a frame base carried by the extraction assembly support member. The container of the extraction assembly is carried by the frame base.

In another aspect, the frame base comprises a sleeve support, a container sleeve carried by the sleeve support and a container sleeve opening in the container sleeve. The container of the extraction assembly is seated in the container sleeve opening.

In another aspect, the apparatus frame comprises a pair of angled frame legs and a pair of spaced-apart frame arms extending from between the frame legs. The extraction assembly mount frame is pivotally carried by the frame arms.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
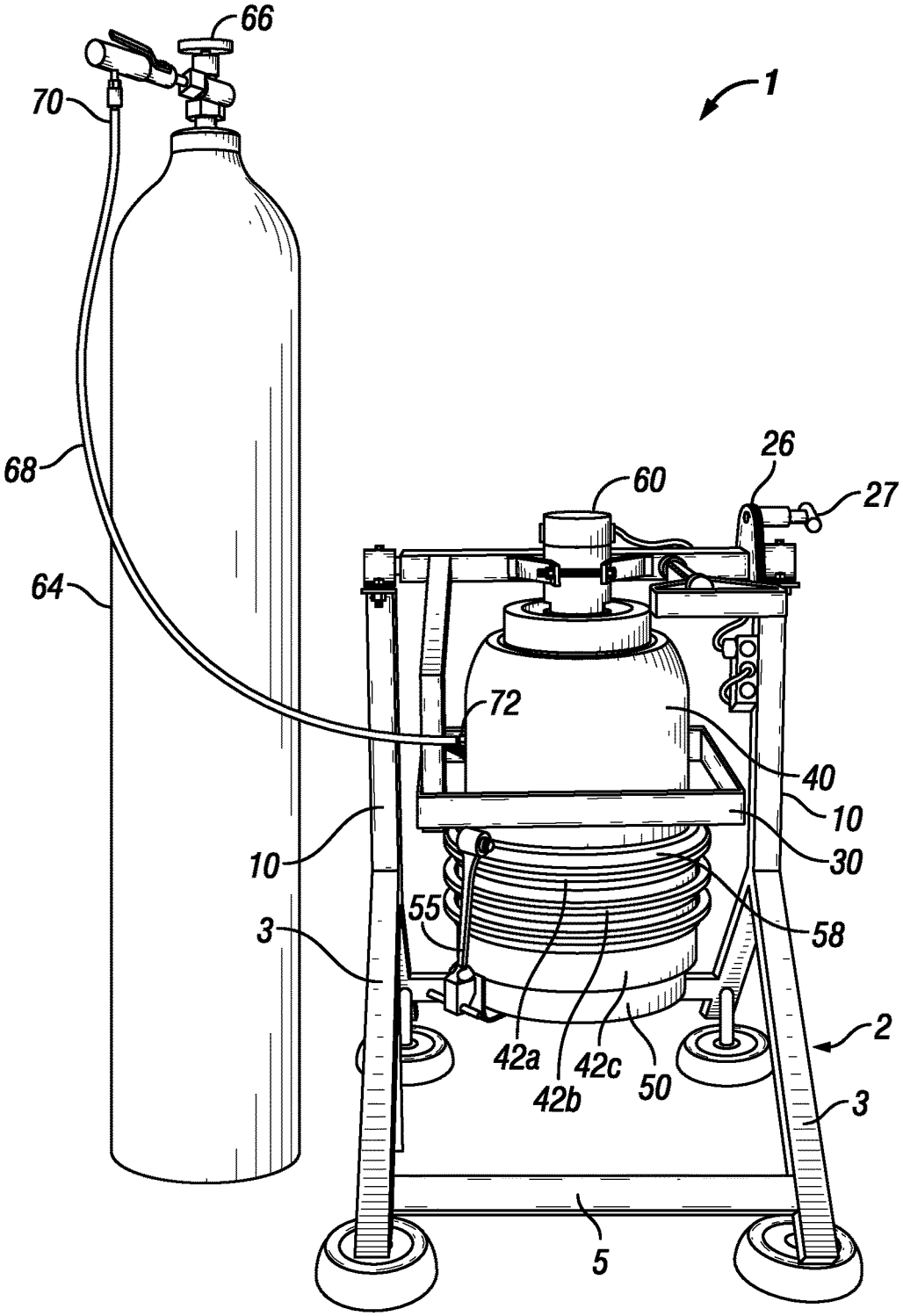
FIG. 1 illustrates a perspective view of an exemplary vegetation material byproduct harvesting apparatus, in accordance with an embodiment of the present invention.
Figure 2:
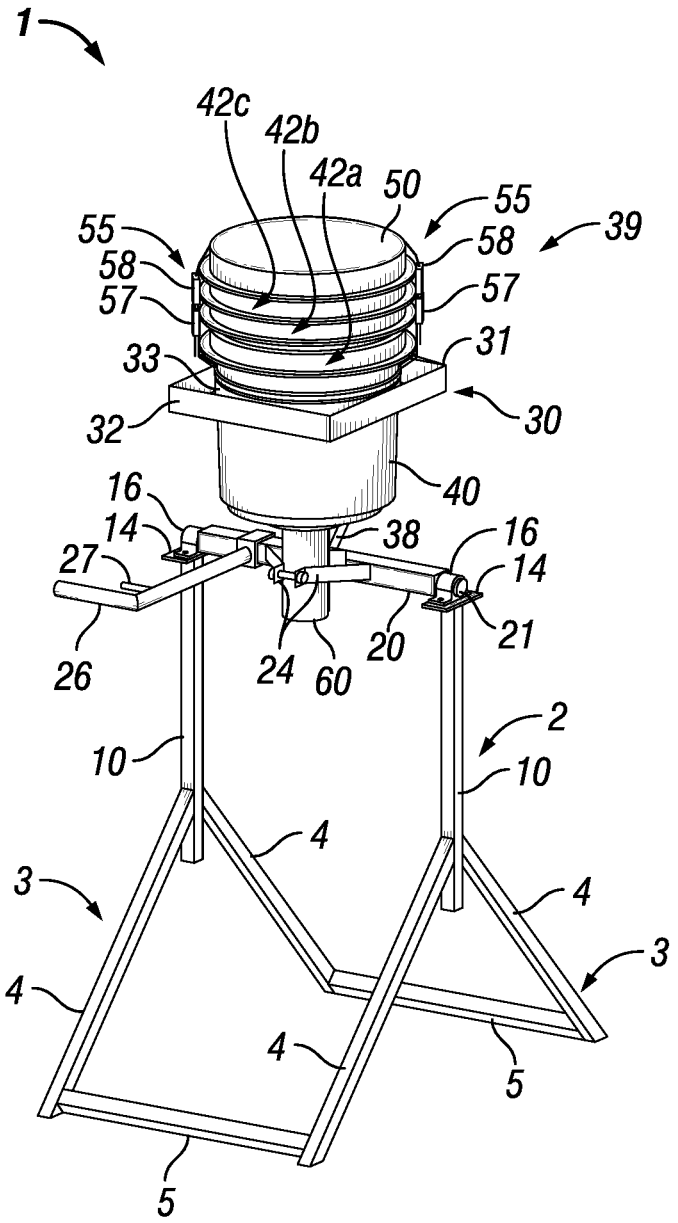
FIG. 2 is a perspective view of an illustrative embodiment of the vegetation material byproduct harvesting apparatus, in accordance with an embodiment of the present invention.
Figure 3:
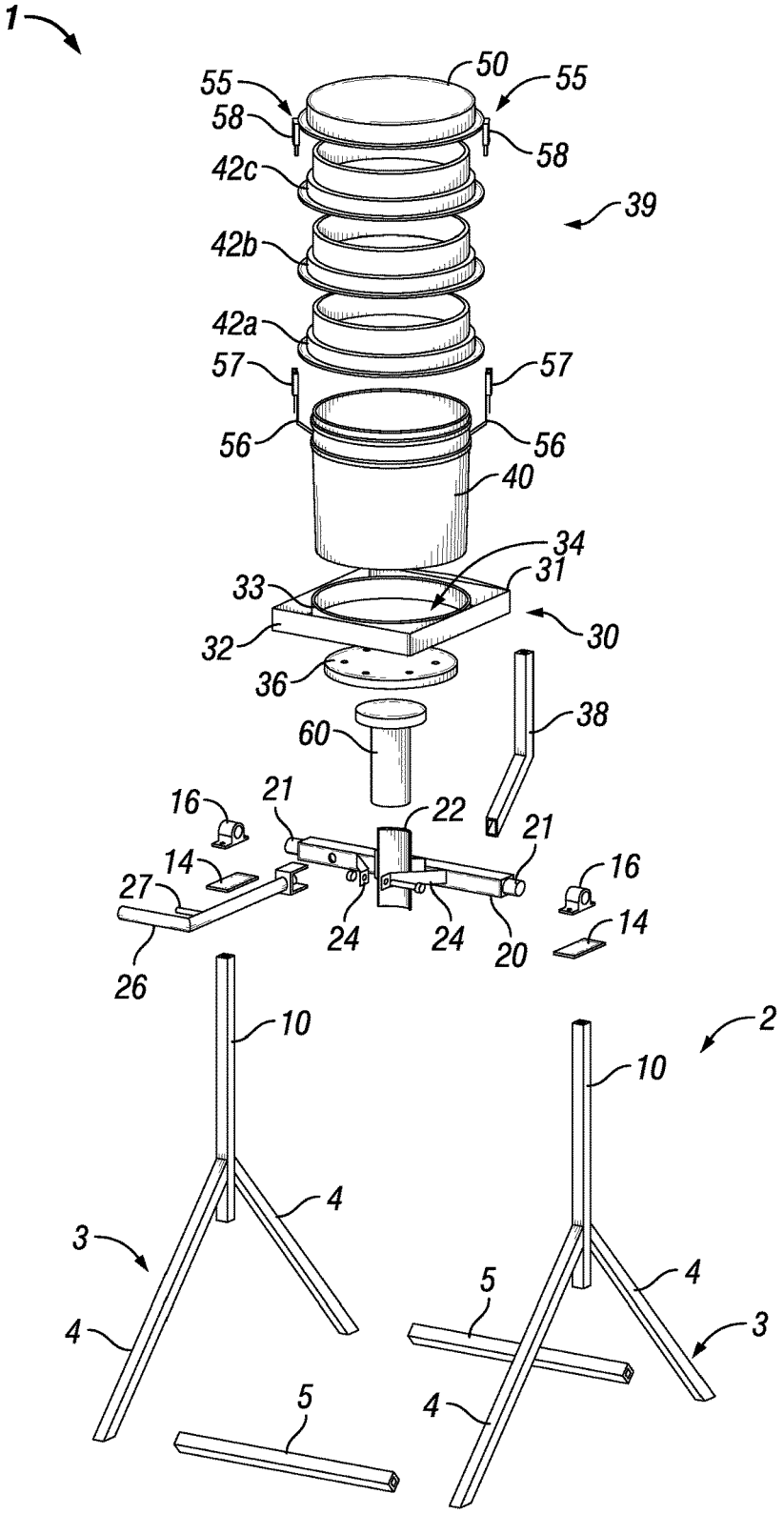
FIG. 3 is an exploded perspective view of an illustrative vegetation material byproduct harvesting apparatus, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

An apparatus 1 and method 200 for harvesting vegetation material byproduct through regulated flow of carbon dioxide and mechanical agitation is referenced in FIGS. 1-16. Illustrative embodiments of the disclosure are generally directed to a vegetation material byproduct harvesting apparatus 1, hereafter "apparatus 1" for extracting various byproducts from vegetation material through a multi-step harvesting process involving flash freezing and dry mechanical agitation of the vegetation material, followed by selective collection of various byproducts based on size and composition of the byproduct.

One advantage provided by the apparatus 1 and method 200 is that the flash freezing process is regulated to accommodate various types of vegetation material, and thus increase efficiency of the harvesting. Specifically, the flow rate and quantity of carbon dioxide used for flash freezing the vegetation material is regulated. Similarly, the force used for agitating the vegetation material may also be regulated to accommodate the different structures of vegetation material. Those skilled in the art will recognize that different vegetation material have different densities, moisture contents, and final byproduct usage. Thus the condition of the vegetation material byproduct may be more efficiently controlled through regulation of the flash freezing process and agitation forces applied to the vegetation material.

In one embodiment, the apparatus 1 is configured to flash freeze a vegetation material with a carbon dioxide, and then agitate the vegetation material at a predetermined vibration intensity. The physical shock of the agitation, as applied to the generally brittle, frozen vegetation material, is effective for dislodging a byproduct from the vegetation material. The apparatus 1 is also unique in that the type of carbon dioxide may be changed and the intensity of the agitation may be adjusted to selectively dislodge from one of many types of byproducts.

After the byproduct is dislodged from the vegetation material, at least one classifier 42, which may have variously sized mesh openings 47, enables selective passage of the byproduct into a collection pan 50. In some embodiments, the vegetation material may include, without limitation, an herb, a flower, a seed, a leaf, a tree, a weed, a vegetable, a fruit, and a multicellular eukaryotes of the kingdom Plantae. The byproduct of the vegetation material may include, without limitation, an oil, an herb, pollen, and any organic byproduct associated with plants and vegetation for a variety of purposes.

In some embodiments, the apparatus 1 includes an apparatus frame 2 for supporting the apparatus 1. A strong supportive structure, such as the apparatus frame 2 is especially important when dealing with controlled release of carbon dioxide gas, mechanical agitation forces that create various torques and forces, and classification of flash frozen vegetation material components into the appropriate collection. An extraction assembly mount frame 30 is pivotally carried by the apparatus frame 2.

The apparatus 1 further comprises a carbon dioxide vessel 64 that is configured to enable containment of a carbon dioxide. The carbon dioxide vessel 64 releases the carbon dioxide for flash freezing the vegetation material. The flash freezing process involves freezing the material and then reducing the surrounding pressure in the carbon dioxide vessel 64 to allow the frozen water in the material to sublimate directly from the solid phase to the gas phase.

Those skilled in the art will recognize that at pressures below 5.13 atmospheres and temperatures below −56.4° C. (−69.5° F.) (the triple point), carbon dioxide changes from a solid to a gas with no intervening liquid form, through this sublimation. Thus, carbon dioxide, and in some embodiments nitrogen, are efficacious for flash freezing the vegetation material.

The apparatus 1 may further include an extraction assembly 39 for mechanically separating the flash frozen vegetation material. The extraction assembly 39 may include a container that is carried by the extraction assembly mount frame, at a first end of the extraction assembly 39. The container 40 contains the vegetation material.

A size adjustable nozzle 74 may extend from the carbon dioxide vessel to carry the carbon dioxide to the container 40 in the extraction assembly 39. The size adjustable nozzle 74 directionally carries the carbon dioxide to the vegetation material inside the container 40. The size adjustable nozzle 74 is unique in that it is configured to increase or decrease in diameter, depending on the flash freezing requirements for the vegetation material. In this manner, the flow rate and quantity (parts-per-million) of carbon dioxide can be regulated.

An agitation motor 60 mechanically engages the container 40, generating various agitating forces useful for dislodging the frozen byproduct from the flash frozen vegetation material. Because of the dehydrated, brittle state of the vegetation material caused by the carbon dioxide, the agitation is enhanced. Thus, the carbon dioxide flash freezes the vegetation material, and the agitation motor 60 forcibly dislodges the frozen byproduct from the vegetation material.

After breaking down the flash frozen vegetation material in the extraction assembly 39, the size classification and collection process begins. At least one classifier 42 is used to segregate the components thereof. The classifier 42 is carried by the container, and may include a classifier mesh with a plurality of mesh openings 47. Further, a collection pan 50 is carried by the at least one classifier at a second end of the extraction assembly for capturing the segregated parts of the vegetation material.

The apparatus 1 further comprises at least one assembly securing mechanism that engages the container and the collection pan. The at least one assembly securing mechanism releasably secures the collection pan and the at least one classifier on the container in the proper alignment, so as to efficiently catch the flash frozen vegetation material components. A conveyor may be used to carry the carbon dioxide from the carbon dioxide vessel to the container.

An illustrative embodiment of the apparatus 1 includes an apparatus frame 2; an extraction assembly mount frame 30 pivotally carried by the apparatus frame 2; an extraction assembly 39 including a container 40 carried by the extraction assembly mount frame 30 at a first end of the extraction assembly 39, whereby the container 40 comprises an inlet aperture 62; an agitation motor 60 mechanically engaging the container 40; at least one classifier 42 carried by the container 40, the at least one classifier 42 having a classifier mesh with a plurality of mesh openings 47; a collection pan 50 carried by the at least one classifier 42 at a second end of the extraction assembly 39; at least one assembly securing mechanism 55 engaging the container 40 and the collection pan 50, the at least one assembly securing mechanism 55 releasably securing the collection pan 50 and the at least one classifier 42 on the container 40; a carbon dioxide vessel 64 disposed adjacently to the container 40, the carbon dioxide vessel 64 configured to enable containment of a carbon dioxide; and a conveyor 68 configured to carry the carbon dioxide from the carbon dioxide vessel 64 to the container 40 through the inlet aperture 62 in the container 40.

Those skilled in the art will recognize that various processes are known for extracting herbs, oils and/or other byproducts from vegetation material and plant in general. These processes may utilize liquids to extract the byproducts through implementation of intricate processes using complex equipment, rendering the processes expensive and complicated and requiring long drying periods.

Those skilled in the art will further recognize that at pressures that fall below 5.13 atmospheres and temperatures below −56.4° C. (−69.5° F.), carbon dioxide ($CO_2$) changes from a solid to a carbon dioxide with no intervening liquid form, through a process called sublimation. The opposite process is called deposition, where $CO_2$ changes from the carbon dioxide to solid phase (dry ice). This unique characteristic of $CO_2$ enables flash freezing of an organic structure, such as a vegetation material or plant. The present invention expeditiously classifies various vegetation material by-products through a flash freezing and dry mechanical agitation process. Specifically, the apparatus 1 adapts the flash freezing function provided by CO2, with the mechanical agitation function provided by an agitation motor, and then selectively harvests the byproducts through at least one classifier 42 to create efficient harvesting of the byproducts from the vegetation material. This helps eliminates the need for messy chemicals and labor intensive processes to collect the byproducts from vegetation material.

Referring to the drawing of FIG. 1, an illustrative embodiment of the vegetation byproduct extraction apparatus 1, hereinafter apparatus, is generally indicated by reference numeral 1. The apparatus 1 may include an apparatus frame 2. An extraction assembly mount frame 30 may be supported by the apparatus frame 2. An extraction assembly 39 may be supported by the extraction assembly mount frame 30. In exemplary application of the apparatus 1, which will be hereinafter described, the extraction assembly 39 may be used to extract pollen, herbs, oils and/or other vegetation byproducts from plant matter or other plant vegetation for any of a variety of purposes.

Figure 4:
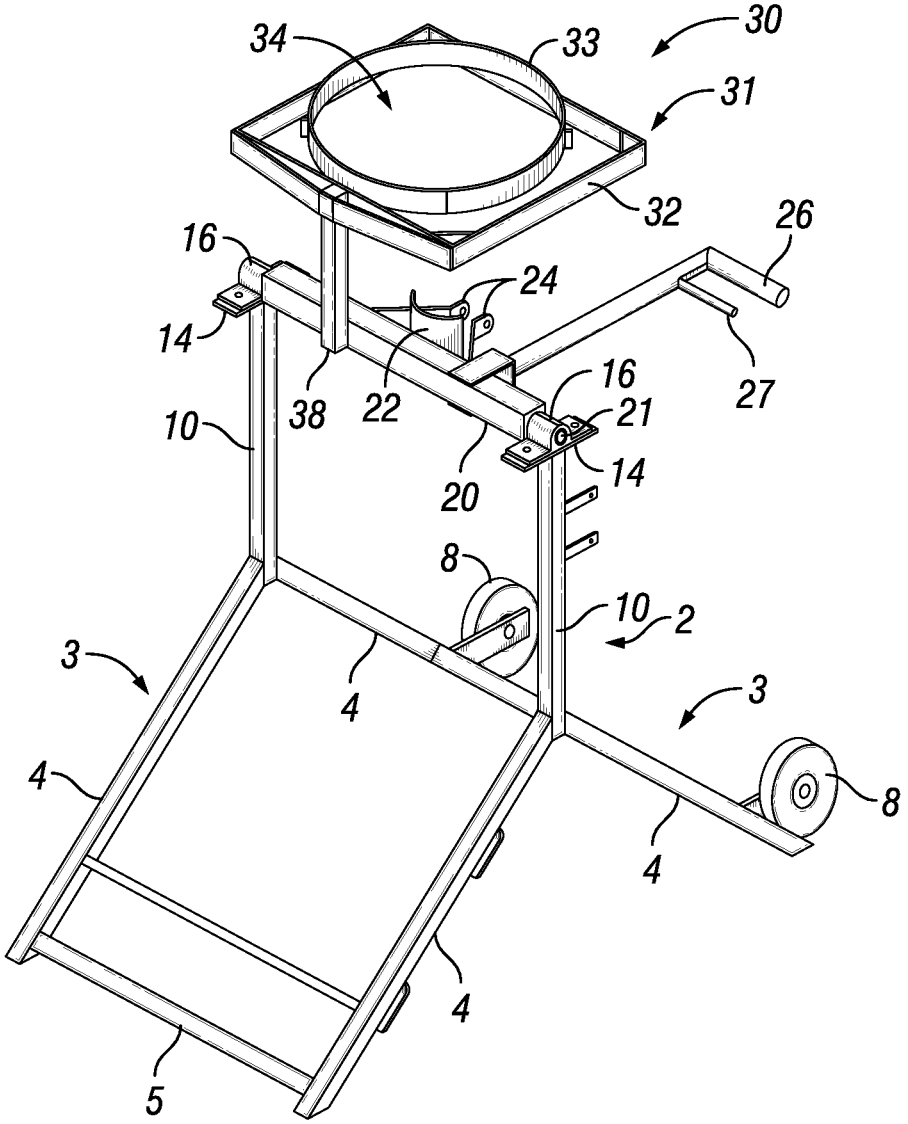
FIG. 4 is a perspective view of a typical apparatus frame and extraction assembly support frame according to an illustrative vegetation material byproduct harvesting apparatus, in accordance with an embodiment of the present invention.
Figure 6:
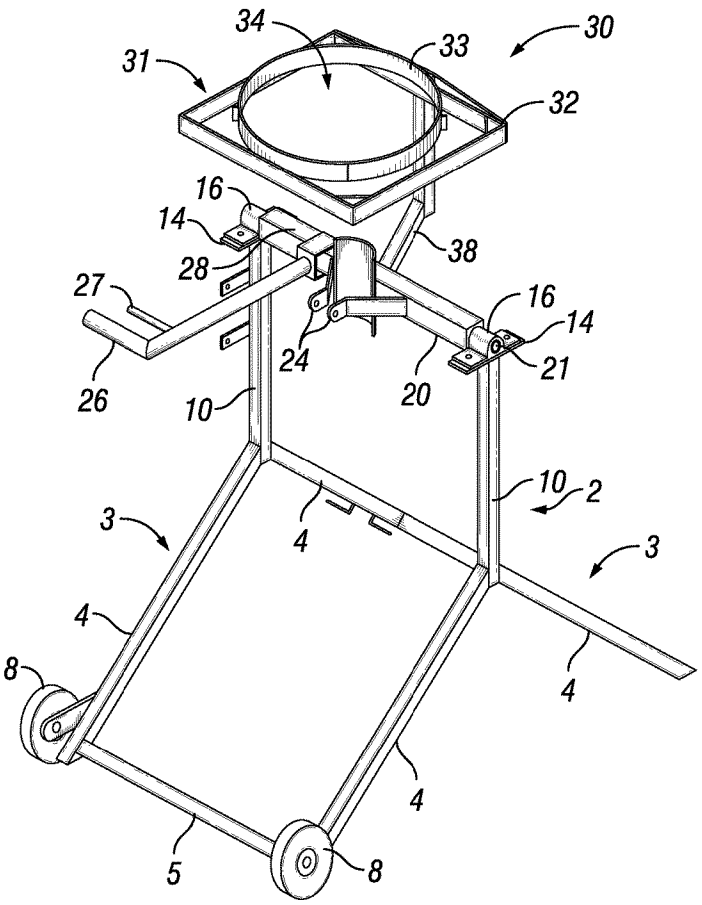
FIG. 6 is a perspective view of a typical apparatus frame and extraction assembly support frame, in accordance with an embodiment of the present invention.
Figure 5:
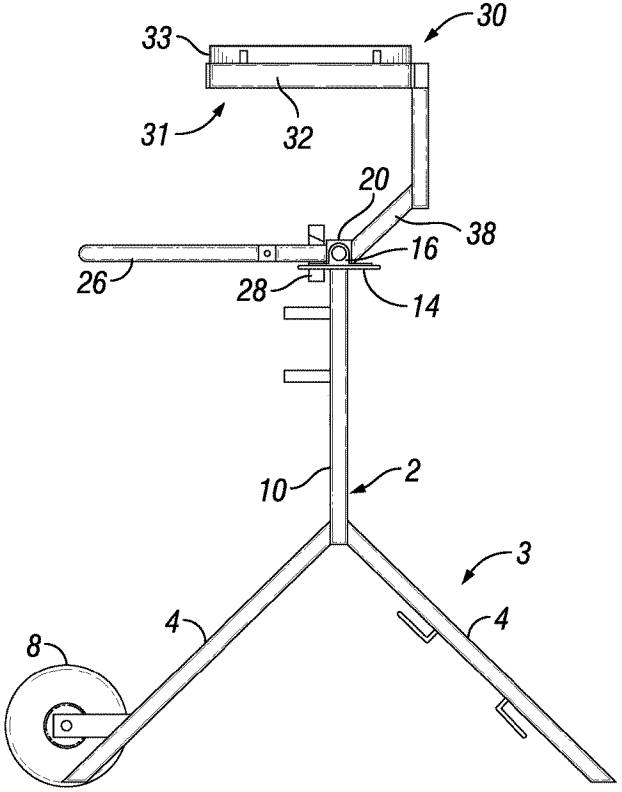
FIG. 5 is a side view of a typical apparatus frame and extraction assembly support frame, in accordance with an embodiment of the present invention.
Figure 8:
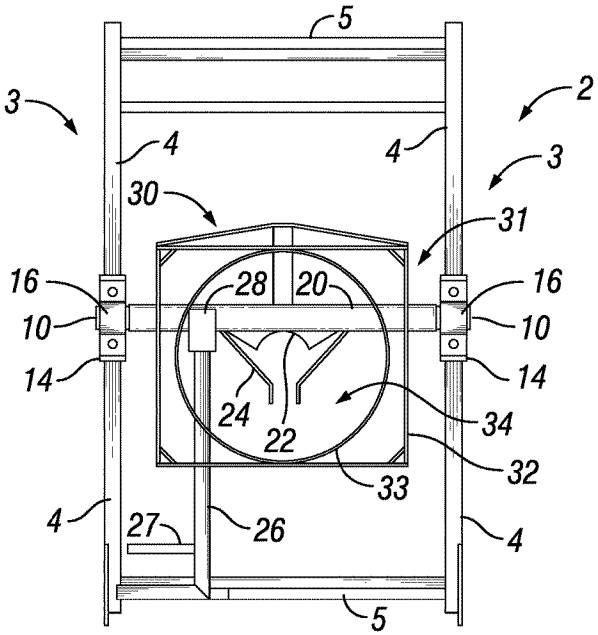
FIG. 8 is a top view of a typical apparatus frame and extraction assembly support frame, in accordance with an embodiment of the present invention.
Figure 7:
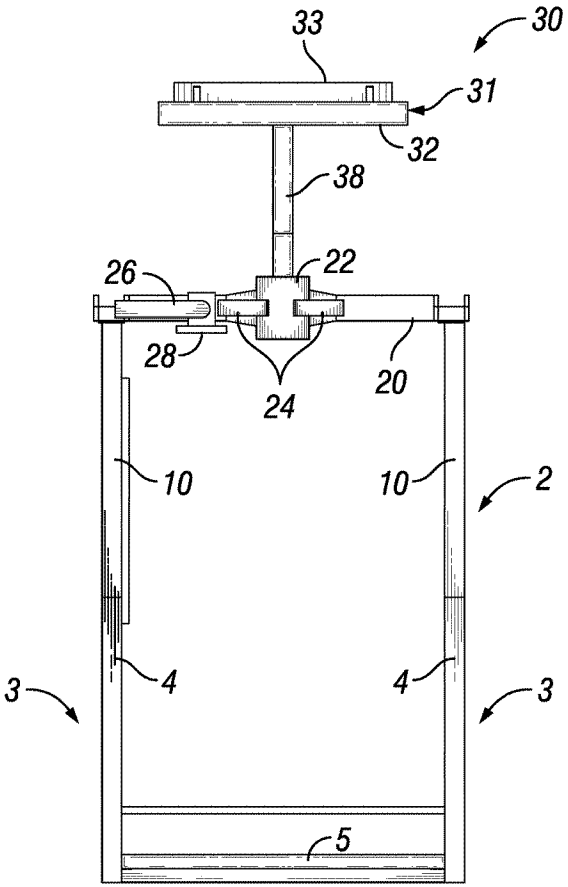
FIG. 7 is a front view of a typical apparatus frame and extraction assembly support frame, in accordance with an embodiment of the present invention.

In some embodiments, the apparatus frame 2 of the apparatus 1 may include a pair of angled frame legs 3. A pair of elongated, parallel, spaced-apart, upward-standing frame arms 10 may extend from between the frame legs 3. Each frame leg 3 may include a pair of spaced-apart side leg members 4 which extend at an angle from the respective frame arms 10. A bottom leg member 5 may extend between the side leg members 4. As illustrated in FIGS. 4-6, in some embodiments, a pair of frame wheels 8 may be provided on one of the frame legs 3 to render the apparatus 1 portable on a flat surface (not illustrated). In some embodiments, the apparatus frame 2 may be fabricated of square tubing components from steel, aluminum, plastic and/or other material.

As FIG. 1 illustrates, a carbon dioxide vessel 64 is disposed adjacent to the apparatus frame 2 and operatively connected thereto. The carbon dioxide vessel 64 is configured to contain and displace a carbon dioxide that is used for flash freezing the vegetation material. In one embodiment, the carbon dioxide vessel 64 is a cylindrical metal container configured to withstand heavy pressures and temperatures below −56.4° C. (−69.5° F.) from the carbon dioxide. In some embodiments, the carbon dioxide vessel 64 may contain, without limitation, carbon dioxide, nitrogen, and combinations thereof.

In some embodiments, a conveyor 68 may configured to carry the displaced carbon dioxide from the carbon dioxide vessel 64 to a container 40 that contains vegetation material. The conveyor 68 comprises a vessel end 70 that receives the carbon dioxide from the carbon dioxide vessel 64, and a container end 72 that engages the inlet aperture 62 of the container 40. The container end 72 may be threaded to rotatably engage the inlet aperture 62.

In some embodiments, a size adjustable nozzle 74 may extend from the inlet aperture 62 of the container 40. The size adjustable nozzle 74 is configured to directionally carry the carbon dioxide from the conveyor 68 to the vegetation material inside the container 40. The size adjustable nozzle 74 has adjustable dimensions, depending on the flash freezing requirements for the vegetation material. For example, in one embodiment, the size adjustable nozzle 74 is configured to increase or decrease in diameter. The size adjustable nozzle 74 works in conjunction with a regulator 66, such as a valve, to carry the appropriate flow rate and quantity of carbon dioxide to the vegetation material in the container 40.

In this manner, the carbon dioxide is controllably displaced from the vessel end 70 to the container end 72 at a flow rate, or displacement rate, which is controlled through varying the diameter of the size adjustable nozzle 74 and manipulating the regulator 66. The regulator 66 may include, without limitation, a valve, a clamp, and a power supply. Thus, for denser vegetation material, a greater quantity of carbon dioxide may be displaced into the container 40. Conversely, for smaller vegetation material, a lesser quantity of carbon dioxide may be displaced into the container 400. This is possible due to the adjustable dimensions of the size adjustable nozzle 74 and the regulator 66.

Those skilled in the art will recognize that carbon dioxide is measured in parts-per-million (ppm) and reported in units of micromole $mol^{-1}$ ($10^{-6}$ mole $CO_2$ per mole of dry air). In this manner, the flow rate and ppm units of carbon dioxide may be regulated to achieve various flash freezing results.

Now turning back to the apparatus frame 2 that forms the supportive foundation for the apparatus 1, FIGS. 2-8 illustrate that the extraction assembly mount frame 30 of the apparatus 1 may be provided on the apparatus frame 2. The extraction assembly mount frame 30 may include an extraction assembly support member 20 which is supported by the frame arms 10 of the apparatus frame 2. The extraction assembly support member 20 may be rotatably mounted relative to the frame arms 10 according to any suitable technique known by those skilled in the art. In some embodiments, a pair of bearing mount plates 14 may terminate the upper ends of the respective frame arms 10. A pair of shaft bearings 16 may be provided on the respective bearing mount plates 14.

In some embodiments, the respective ends of the extraction assembly support member 20 may terminate in a pair of support member bearings 21 which are inserted into the respective shaft bearings 16 such that the extraction assembly support member 20 is capable of rotating 360 degrees about its longitudinal axis. An extraction assembly positioning handle 26 may extend from the extraction assembly support member 20 to facilitate manual rotation of the extraction assembly support member 20 and selective deployment of the extraction assembly mount frame 30 in an upright material loading position (FIG. 10) for purposes which will be hereinafter described.

Accordingly, a frame locking mechanism 28 (FIGS. 6-11) on the extraction assembly support member 20 may selectively engage one or both of the shaft bearings 16 according to the knowledge of those skilled in the art to facilitate locking of the extraction assembly mount frame 30 in the upright material loading position. A handle trigger 27 may be provided on the extraction assembly positioning handle 26 to operably engage the frame locking mechanism 28 and facilitate selective engagement of the frame locking mechanism 28 with the shaft bearing or bearings 16 upon release of the handle trigger 27 and disengagement of the frame locking mechanism 28 from the shaft bearing or bearings 16 upon depression of the handle trigger 27.

The extraction assembly mount frame 30 may further include a frame base 31 having a generally square-shaped sleeve support 32 and a container sleeve 33 in the sleeve support 32. The container sleeve 33 has a container sleeve opening 34. An assembly stabilizing arm 38 may mount the sleeve support 32 of the frame base 31 on the extraction assembly support member 20.

The extraction assembly 39 of the apparatus 1 may include a container 40 which is nested in the container sleeve opening 34 in the container sleeve 33 of the frame base 31 on the extraction assembly mount frame 30. The container 40 is sized and configured to contain the vegetation material (not illustrated) from which the vegetation byproducts are to be extracted. The container comprises an inlet aperture 62 that is configured to receive the container end of the conveyor. Thus, through the inlet aperture 62 in the container 40, the carbon dioxide may be displaced from the carbon dioxide vessel 64 to the vegetation material in the container for flash freezing thereof.

In some embodiments, a vibrating agitation motor 60 may be mounted on the extraction assembly support member 20 of the extraction assembly mount frame 30 beneath the container 40. The agitation motor 60 mechanically engages the container 40 for selective vibration of the container 40 according to the knowledge of those skilled in the art. Accordingly, a resilient dampening pad 36 may be attached to the bottom of the container 40 through fasteners (not illustrated) and/or other attachment technique.

In one embodiment, the agitation motor 60 engages the dampening pad 36 and vibrates the container 40 through the dampening pad 36 in application of the apparatus 1, which will be hereinafter described. It is significant to note that the agitation motor 60 may also apply various other forcible means of forcible agitation, including, without limitation, gyratory motion, reciprocal motion, oscillating motion, centrifugal forces, shaking, scrubbing, sedimentation, sieving, stripping, and sublimation.

In some embodiments, a motor switch (not illustrated) may be electrically connected to the agitation motor 60 and mounted on the apparatus frame 2, the extraction assembly mount frame 30 or any other suitable component of the apparatus 1 to facilitate selective operation of the agitation motor 60. In some embodiments, the motor switch may include a speed control dial or other mechanism to selectively vary the vibrational speed of the agitation motor 60.

The agitation motor 60 may be mounted on the extraction assembly support member 20 of the extraction assembly mount frame 30 according to any suitable technique which is known by those skilled in the art. In some embodiments, a concave motor mount plate 22 may be welded, fastened and/or otherwise attached to the extraction assembly support member 20. A pair of spaced-apart agitation motor mount arms 24 may extend from the extraction assembly support member 20 on opposite sides of the motor mount plate 22.

In some embodiments, the agitation motor mount arms 24 may secure the agitation motor 60 against the motor mount plate 22 to mount the agitation motor 60 on the extraction assembly support member 20. The agitation motor 60 may be additionally or alternatively mounted on the extraction assembly support member 20 using mechanical fasteners (not illustrated) and/or other attachment technique which is suitable for the purpose.

Figure 12:
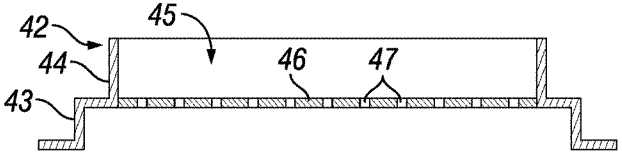
FIG. 12 is a cross-sectional view of a typical classifier of the extraction assembly, in accordance with an embodiment of the present invention.
Figure 9:
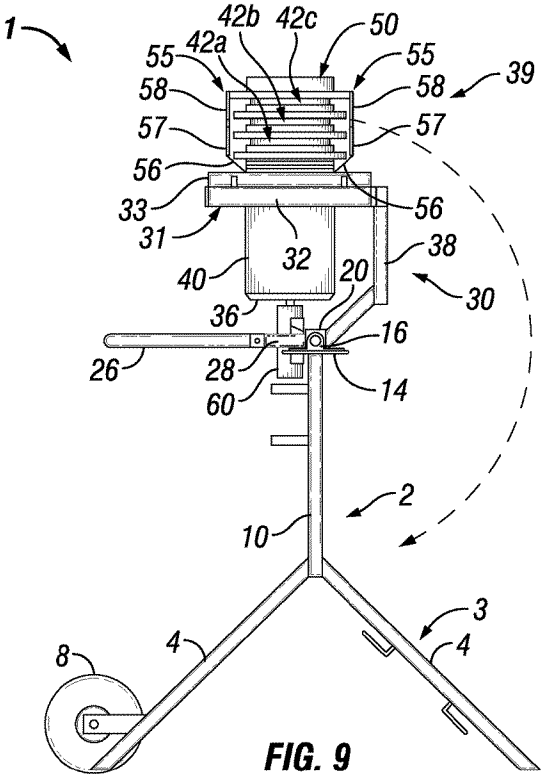
FIG. 9 is a side view of an illustrative embodiment of the vegetation material byproduct harvesting apparatus, with an extraction assembly of the apparatus deployed in an upright loading position in exemplary application of the apparatus, in accordance with an embodiment of the present invention.

The extraction assembly 39 further includes at least one classifier 42 which is placed on the container 40 when the extraction assembly 39 is deployed in the upright loading position illustrated in FIG. 9. As illustrated in FIG. 12, each classifier 42 may include a classifier base 43 and a classifier wall 44 which extends from the classifier base 43 and has a classifier interior 45. A classifier mesh 46 having mesh openings 47 of selected size is provided in the classifier interior 45.

As illustrated in FIGS. 1, 2, 3, 9 and 10, in exemplary application of the apparatus 1, multiple classifiers 42 are placed on the container 40. In the example illustrated, a first classifier 42*a* is placed on the container 40; a second classifier 42*b* is placed on the first classifier 42*a*; and a third classifier 42*c* is placed on the second classifier 42*b*. The mesh openings 47 (FIG. 12) in the classifier mesh 46 of the first classifier 42*a*, the second classifier 42*b* and the third classifier 42*c* may have different sizes for purposes which will be hereinafter described. In some embodiments, the first classifier 42*a*, the second classifier 42*b* and the third classifier 42*c* may have mesh openings 47 of progressively decreasing size.

Figure 11:
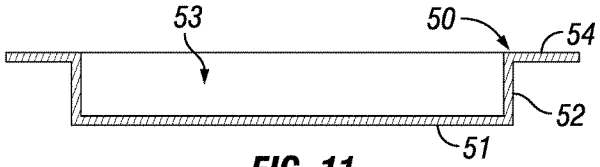
FIG. 11 is a cross-sectional view of a typical collection pan of the extraction assembly, in accordance with an embodiment of the present invention.

The extraction assembly 39 further includes a collection pan 50 which is placed on the classifier or classifiers 42 when the extraction assembly 39 is deployed in the upright loading position illustrated in FIG. 9. As illustrated in FIG. 11, the collection pan 50 may include a collection pan bottom 51, a collection pan wall 52 extending from the collection pan bottom 51, a collection pan interior 53 formed by the collection pan wall 52 and a collection pan rim 54 which extends outwardly from the collection pan wall 52.

At least one assembly securing mechanism 55 engages and secures the classifier or classifiers 42 and the collection pan 50 to the container 40 of the extraction assembly 39. The assembly securing mechanism 55 may have any design or construction which is suitable for the purpose. In some embodiments, each assembly securing mechanism 55 may include a connecting strap 56 which is attached to and extends from the container 40.

In some embodiments, a bottom connector 57 may be provided on the connecting strap 56. A top connector 58 may be provided on the collection pan 50. The top connector 58 is complementary to the bottom connector 57 and detachably engages the bottom connector 57 to secure the classifier or classifiers 42 and the collection pan 50 on the container 40 as the extraction assembly mount frame 30 and extraction assembly 39 thereon are repositioned from the upright loading position illustrated in FIG. 8 to the inverted unloading position illustrated in FIG. 10, as will be hereinafter described.

Referring next to FIGS. 9-15 of the drawings, in exemplary application, the apparatus 1 may be used to extract vegetation material particles of pollen, herbs, oils and/or other vegetation byproducts from vegetation material or other plant for any of a variety of purposes. Accordingly, the extraction assembly mount frame 30 and the extraction assembly 39 thereon are initially deployed in the upright vegetation material-loading position illustrated in FIG. 9 typically by rotation of the assembly positioning handle 26 and manual release of the handle trigger 27, such that the frame locking mechanism 28 engages the shaft bearing or bearings 28 and locks the extraction assembly mount frame 30 in the upright position.

Figure 13:
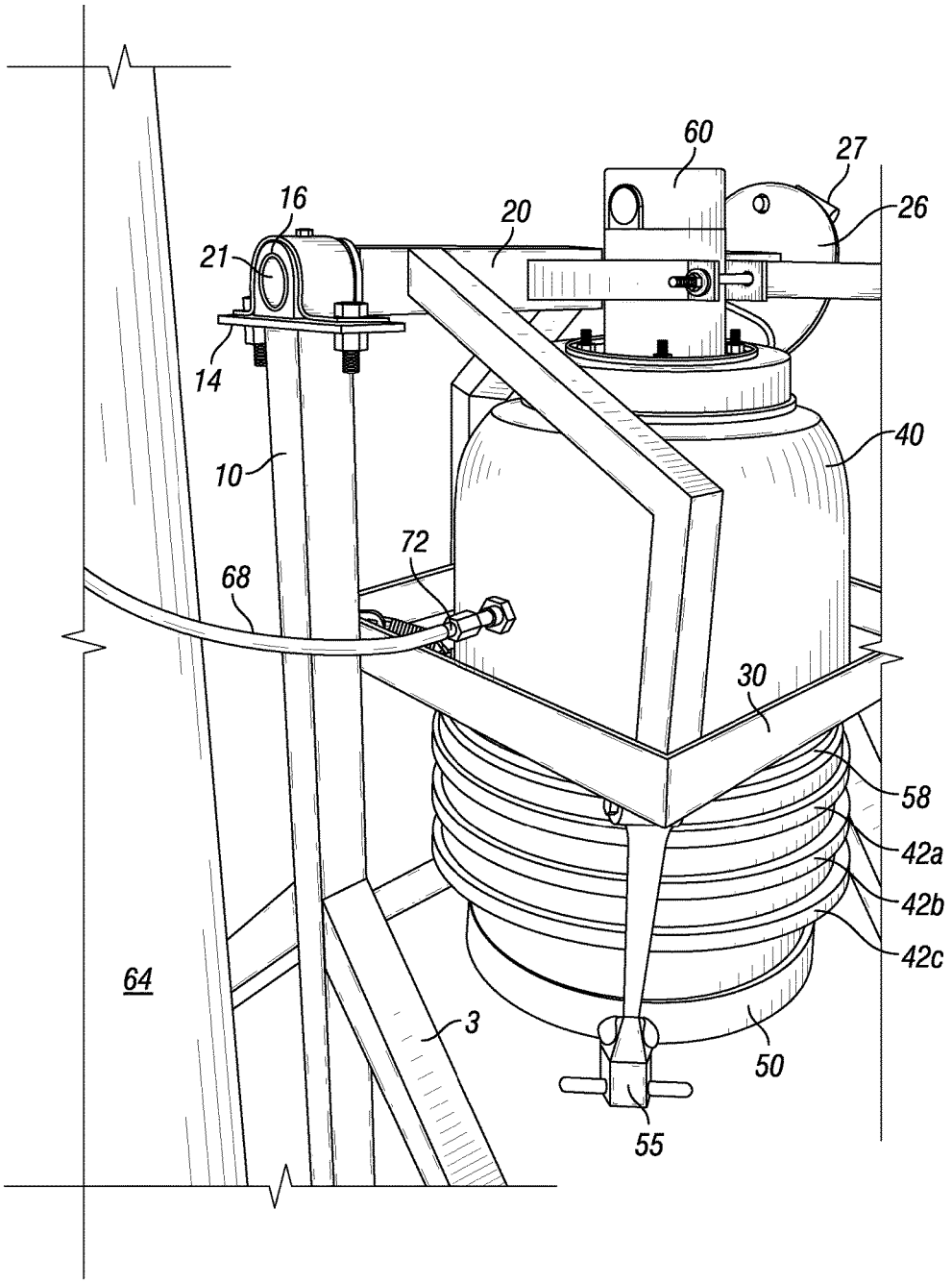
FIG. 13 is a perspective view of a typical container and at least one classifier, in accordance with an embodiment of the present invention.

In some embodiments, the assembly securing mechanisms 55 may be unfastened and the classifiers 42 and the collection pan 50 removed from the container 40. The vegetation material, which may have been previously pulverized or shredded using a conventional mechanical pulverizing or shredding process, is placed in the container. As FIG. 13 illustrates, the carbon dioxide is then displaced into the container for flash freezing the vegetation material. The carbon dioxide may include $CO_2$, nitrogen, or combinations thereof.

Figure 14:
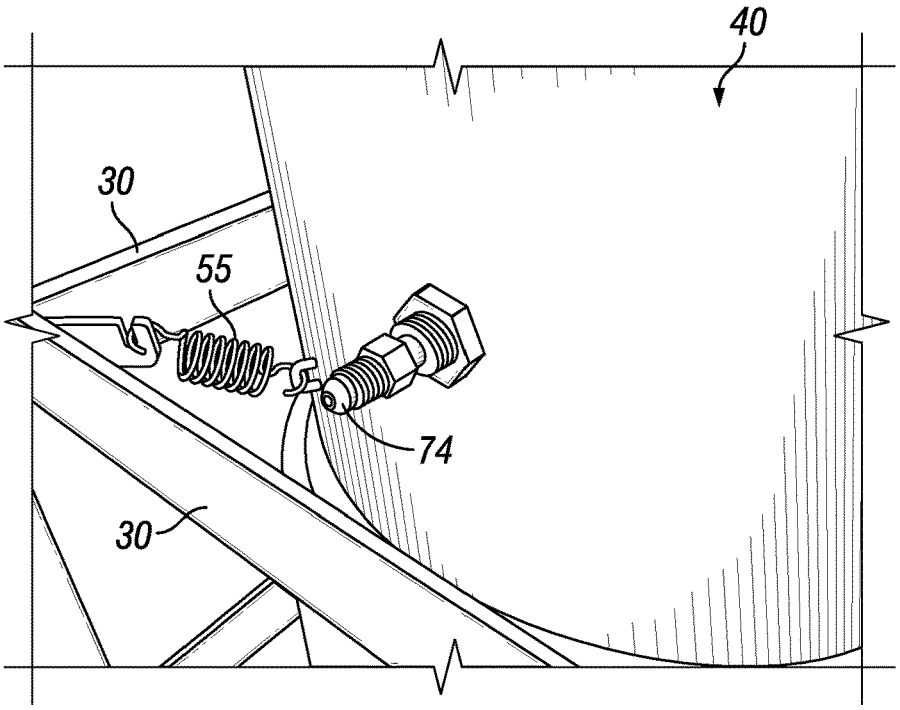
FIG. 14 is a close up view of a typical container, in accordance with an embodiment of the present invention.
Figure 15:
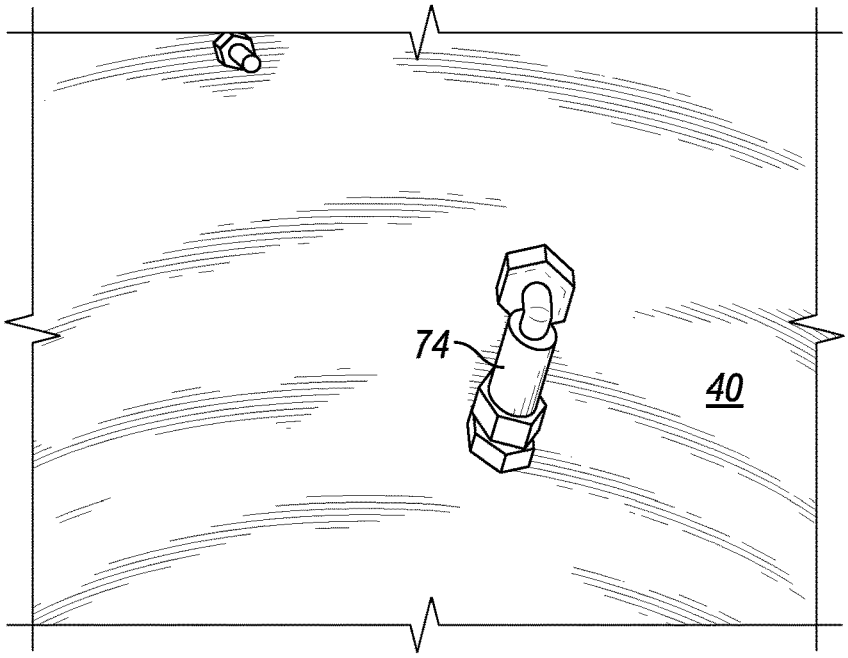
FIG. 15 is a close up view of a typical size adjustable nozzle in the container, in accordance with an embodiment of the present invention.

Looking now at FIG. 14, the carbon dioxide is carried from the carbon dioxide vessel 64 to the container 40 through the conveyor 68. In one embodiment, the conveyor 68 is a metal tube that is configured to withstand temperatures below −56.4° C. (−69.5° F.). The conveyor comprises a vessel end 70 that receives the carbon dioxide from the carbon dioxide vessel 64, and a container end 72 that engages the inlet aperture 62 of the container 40. In some embodiments, the container end 72 may be threaded to rotatably engage the inlet aperture 62. As FIG. 15 shows, a size adjustable nozzle 74 extends from the inlet aperture 62 to directionally carry the carbon dioxide towards the vegetation material inside the container 40.

Next, at least one of the classifiers 42 is placed on the container 40, the collection pan 50 is placed on the classifier or classifiers 42 and the assembly securing mechanisms 55 are fastened. In subsequent operation of the apparatus 1, which will be hereinafter described, the classifier or classifiers 42 that were selected and secured in the extraction assembly 39 will sift and remove vegetation particles having a selected size from the vegetation material which was placed in the container 40. Which of the classifiers 42 is selected may depend on the size of the mesh openings 47 (FIG. 12) in the classifier mesh 46 of the classifier or classifiers 42 and thus, the size of the vegetation particles which are to be extracted from the vegetation material and collected in the collection pan 50.

For example and without limitation, in some applications, the first classifier 42*a* (having the largest mesh openings 47) may be secured in the extraction assembly 39 to facilitate removal of the largest vegetation particles from the vegetation material. In some applications, both the first classifier 42*a* and the second classifier 42*b* (having the intermediate-sized mesh openings 47) may be secured in the extraction assembly 39 to remove both the largest and the intermediate-sized vegetation particles from the vegetation material.

In still other applications, the first classifier 42*a*, the second classifier 42*b* and the third classifier 42*c* may be secured in the extraction assembly 39 to remove large, intermediate and small vegetation material particles from the vegetation material such that only the vegetation particles which are smaller than the size of the mesh openings 47 in the third classifier 42*c* and/or oils are removed from the vegetation material and fall into the collection pan 50.

After the selected classifier or classifiers 42 is/are secured in the extraction assembly 39, the agitation motor 60 is operated to vibrate the container 40 at a selected vibrational speed and for a selected operating time (such as 5 minutes, for example and without limitation). Accordingly, vibration of the container 40 loosens the vegetation material in the container 40 preporatory to sifting.

The carbon dioxide which was displaced into the container 40 with the vegetation material flash freezes the vegetation particles and aids in separation of oil from the particles. The vibrational speed and operating time for the agitation motor 60 may depend on such factors as the type of vegetation material which is selected for sifting as well as the size of the vegetation particles which are to be removed from the vegetation material.

Figure 10:
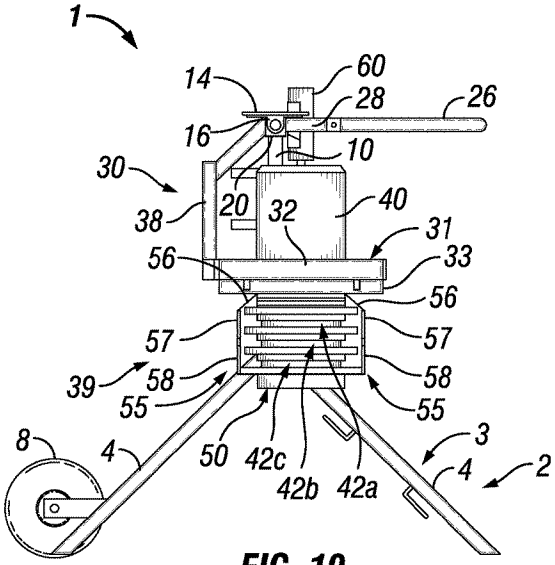
FIG. 10 is a side view of the illustrative vegetation material byproduct harvesting apparatus with the extraction assembly deployed in an inverted unloading position in exemplary application of the apparatus, in accordance with an embodiment of the present invention.

As illustrated in FIGS. 9 and 10, after vibration of the container 40, the assembly positioning handle 26 is operated to reposition the extraction assembly mount frame 30 and extraction assembly 39 from the upright material-loading position illustrated in FIG. 9 to the inverted material-unloading position illustrated in FIG. 10.

Accordingly, the handle trigger 27 on the extraction assembly positioning handle 26 may initially be squeezed, depressed or otherwise manipulated to facilitate disengagement of the frame locking mechanism 28 from the shaft bearing or bearings 16, after which the assembly repositioning handle 26 is rotated to reposition the extraction assembly mount frame 30, as indicated by the arrow in FIG. 9. Inversion of the extraction assembly 39 causes the vegetation material to fall from the container 40, through the classifier or classifiers 42 previously secured in the extraction assembly 39 and into the collection pan 50.

Thus, only the vegetation particles which are smaller than the smallest mesh openings 47 (FIG. 12) in the classifier or classifiers 42 and/or oil extracted from the vegetation material falls into the collection pan 50. The assembly securing mechanisms 55 are next unfastened and the collection pan 50 and classifier or classifiers 42 are removed from the container 40. The vegetation particles and/or oil which were collected are removed from the collection pan 50 and may be stored or further processed depending on the desired use of the vegetation particles. In some applications, the process may be repeated to ensure complete removal of the vegetation particles of selected size from the vegetation material. The collection pan 50, classifier or classifiers 42 and container 40 may then be cleaned for subsequent use.

Figure 16:
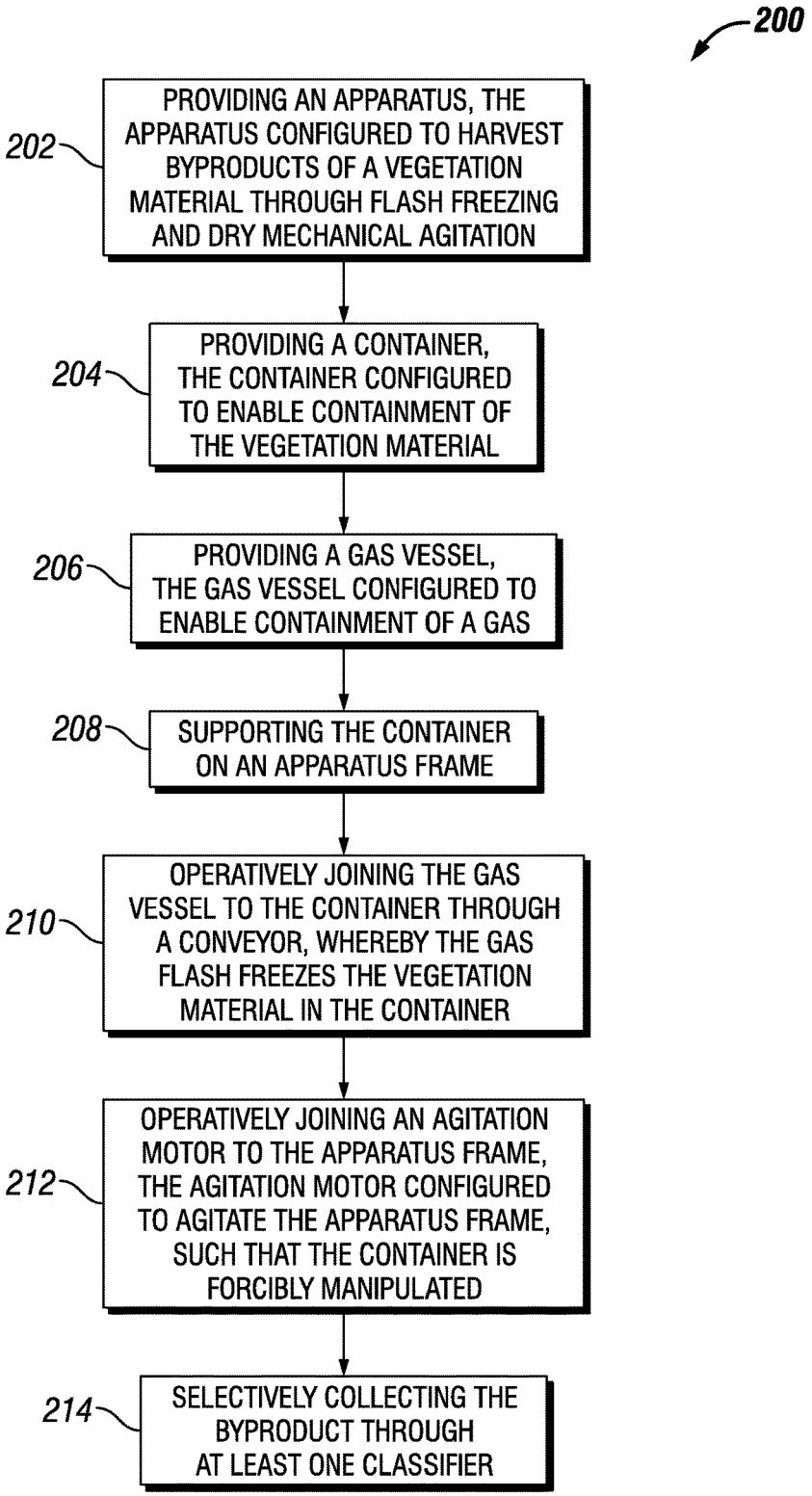
FIG. 16 illustrates a flowchart of an exemplary vegetation material byproduct harvesting method, in accordance with an embodiment of the present invention.

FIG. 16 illustrates yet another means for operation of the apparatus through use of an exemplary method 200 for harvesting a byproduct of vegetation material through flash freezing and mechanical agitation. The method 200 utilizes through a multi-step process involving flash freezing and dry mechanical agitation of the vegetation material. In one embodiment, the method 200 flash freezes a vegetation material with a carbon dioxide, and then applies vibrational agitation to the frozen vegetation material at a predetermined vibrational intensity. The physical shock of the agitation on the generally brittle, frozen vegetation material is effective for dislodging the byproduct from the vegetation material. The byproducts are selectively collected through use of at least one classifier 42 having variously sized mesh openings 47.

In one embodiment, the method 200 comprises an initial Step 202 of providing an apparatus 1, the apparatus 1 configured to harvest byproducts of a vegetation material through flash freezing and dry mechanical agitation of a vegetation material. The method 200 may further comprise a Step 204 of providing a container 40, the container 40 configured to enable containment of the vegetation material. A Step 206 includes providing a carbon dioxide vessel 64, the carbon dioxide vessel 64 configured to enable containment of a carbon dioxide. In some embodiments, the carbon dioxide may be used to flash freeze the vegetation material, which enables more efficient mechanical separation of the byproduct during mechanical agitation.

In some embodiments, a Step 208 comprises supporting the container on an apparatus frame 2. The apparatus frame 2 provides the structural foundation for the apparatus 1. In some embodiments, the apparatus frame 2 of the apparatus 1 may include a pair of angled frame legs 3. A pair of elongated, parallel, spaced-apart, upward-standing frame arms 10 may extend from between the frame legs 3. Each frame leg 3 may include a pair of spaced-apart side leg members 4 which extend at an angle from the respective frame arms 10. A bottom leg member 5 may extend between the side leg members 4.

A Step 210 includes operatively joining the carbon dioxide vessel 64 to the container 40 through a conveyor 68 and a size adjustable nozzle 74, whereby the carbon dioxide flash freezes the vegetation material in the container 40. The carbon dioxide may include carbon dioxide and/or nitrogen. In some embodiments, a Step 212 may include operatively joining an agitation motor 60 to the apparatus frame 2, the agitation motor 60 configured to agitate the apparatus frame 2, such that the container 40 is forcible manipulated, whereby a byproduct disengages from the flash frozen vegetation material.

A final Step 214 of the method 200 comprises selectively collecting the byproduct through at least one classifier 42. In one embodiment, multiple classifiers 42 are placed on the container 40. In the example illustrated, a first classifier 42*a* is placed on the container 40; a second classifier 42*b* is placed on the first classifier 42*a*; and a third classifier 42*c* is placed on the second classifier 42*b*. The mesh openings 47 (FIG. 11) in the classifier mesh 46 of the first classifier 42*a*, the second classifier 42*b* and the third classifier 42*c* may have different sizes for selectively separating and harvesting the byproducts. For example, plant shavings, pollen, and oils may be separated through use of different sized mesh openings 47 in a stacked configuration.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A vegetation material byproduct harvesting apparatus suitable for expeditiously extracting vegetation and other plant byproducts from vegetation material through a flash freezing and dry mechanical agitation process and selectively harvesting byproducts based on size and composition of the byproducts, the apparatus comprising:

an apparatus frame;

an extraction assembly mount frame pivotally carried by the apparatus frame;

an extraction assembly including:

a container carried by the extraction assembly mount frame at a first end of the extraction assembly, the container suitably sized and configured to receive a vegetation material;

an agitation motor mechanically engaging the container to agitate and dislodge a byproduct from the vegetation material;

at least one classifier carried by the container, the at least one classifier having a classifier mesh with a plurality of mesh openings;

a collection pan carried by the at least one classifier at a second end of the extraction assembly;

at least one assembly securing mechanism engaging the container and the collection pan, the at least one assembly securing mechanism releasably securing the collection pan and the at least one classifier on the container; and a carbon dioxide vessel, the carbon dioxide vessel configured to enable containment of a carbon dioxide;

a conveyor, the conveyor configured to carry the carbon dioxide from the carbon dioxide vessel to the container to flash-freeze the vegetation material in the container;

a size adjustable nozzle, the size adjustable nozzle disposed between the conveyor and the container, the size adjustable nozzle configured to regulate the flow of the carbon dioxide from the conveyor to the container, the size adjustable nozzle further configured to have adjustable dimensions; and a regulator, the regulator configured to regulate the flow of the carbon dioxide from the carbon dioxide vessel to the container, whereby the size adjustable nozzle and the regulator work in conjunction to regulate a flow rate and a quantity of the carbon dioxide being carried to the container.

2. The apparatus of claim 1, wherein the adjustable dimensions of the size adjustable nozzle comprise increasing and decreasing diameters.

3. The apparatus of claim 1, wherein the regulator is a valve.

4. The apparatus of claim 1, wherein the conveyor comprises a vessel end and a container end.

5. The apparatus of claim 4, wherein container end of the conveyor is configured to threadably engage the inlet aperture of the container.

6. The apparatus of claim 1, wherein the conveyor comprises a metal tube.

7. The apparatus of claim 1, wherein the carbon dioxide vessel is further configured to enable containment of a nitrogen.

8. The apparatus of claim 1, wherein the apparatus further comprises an assembly positioning handle carried by the extraction assembly mount frame.

9. The apparatus of claim 8, wherein the apparatus further comprises a frame locking mechanism carried by the extraction assembly mount frame and releasably engaging the apparatus frame and a handle trigger carried by the assembly positioning handle and engaging the frame locking mechanism.

10. The apparatus of claim 1, wherein the extraction assembly mount frame comprises an extraction assembly support member rotatably carried by the apparatus frame, and wherein the container is carried by the extraction assembly support member.

11. The apparatus of claim 10, wherein the apparatus further comprises a motor mount plate carried by the extraction assembly support member and a pair of agitation motor mount arms carried by the extraction assembly support member on opposite sides of the motor mount plate, and wherein the agitation motor is carried by the motor mount plate and the pair of agitation motor mount arms.

12. The apparatus of claim 10, wherein the extraction assembly mount frame comprises a frame base carried by the extraction assembly support member, and wherein the container of the extraction assembly is carried by the frame base.

13. The apparatus of claim 12, wherein the frame base comprises a sleeve support, a container sleeve carried by the sleeve support and a container sleeve opening in the container sleeve, the container of the extraction assembly seated in the container sleeve opening.

14. The apparatus of claim 1, wherein the apparatus frame comprises a pair of angled frame legs and a pair of spaced-apart frame arms extending from between the frame legs, and the extraction assembly mount frame is pivotally carried by the frame arms.

15. A vegetation material byproduct harvesting apparatus suitable for expeditiously extracting vegetation and other plant byproducts from vegetation material through a flash freezing and dry mechanical agitation process and selectively harvesting byproducts based on size and composition of the byproducts, the apparatus comprising:

an apparatus frame;

an extraction assembly mount frame selectively positional in an upright material loading position and an inverted material unloading position, the extraction assembly mount frame including:

an extraction assembly support member rotatably carried by the apparatus frame;

an assembly stabilizing arm carried by the extraction assembly support member;

a frame base carried by the assembly stabilizing arm;

an assembly positioning handle carried by the extraction assembly support member;

a frame locking mechanism carried by the extraction assembly mount frame and releasably engaging the apparatus frame; and a handle trigger carried by the assembly positioning handle and engaging the frame locking mechanism;

an extraction assembly including:

a container carried by the frame base of the extraction assembly mount frame at a first end of the extraction assembly, the container comprising an inlet aperture, the container suitably sized and configured to receive vegetation material;

an agitation motor carried by the extraction assembly support member, the agitation motor mechanically engaging the container;

a plurality of classifiers carried by the container, the plurality of classifiers each including:

a classifier base;

a classifier wall extending from the classifier base;

a classifier interior formed by the classifier wall; and a classifier mesh carried by the classifier wall and having a plurality of mesh openings;

the plurality of mesh openings of the plurality of classifiers having different sizes, respectively;

a collection pan carried by the at least one classifier at a second end of the extraction assembly;

at least one assembly securing mechanism engaging the container and the collection pan, the at least one assembly securing mechanism releasably securing the collection pan and the at least one classifier on the container;

a carbon dioxide vessel, the carbon dioxide vessel configured to enable containment of a carbon dioxide;

a conveyor, the conveyor comprising a vessel end and a container end, the vessel end configured to join with the vessel, the container end configured to join with the inlet aperture of the container, the conveyor configured to carry the carbon dioxide from the carbon dioxide vessel to the container to flash-freeze the vegetation material in the container;

a size adjustable nozzle, the size adjustable nozzle disposed between the conveyor and the container, the size adjustable nozzle configured to regulate the flow of the carbon dioxide from the conveyor to the container, the size adjustable nozzle further configured to have adjustable dimensions; and a regulator, the regulator configured to regulate the flow of the carbon dioxide from the carbon dioxide vessel to the container, whereby the size adjustable nozzle and the regulator work in conjunction to regulate a flow rate and a quantity of the carbon dioxide being carried to the container.

16. A vegetation material byproduct flash freeze harvesting method suitable for expeditiously extracting vegetation and other plant byproducts from vegetation material through a flash freezing and dry mechanical agitation process and selectively harvesting byproducts based on size and composition of the byproducts, the method comprising:

providing an apparatus, the apparatus configured to harvest byproducts of a vegetation material through flash freezing and dry mechanical agitation;

providing a container, the container configured to enable containment of the vegetation material;

providing a carbon dioxide vessel, the carbon dioxide vessel configured to enable containment of a carbon dioxide;

supporting the container on an apparatus frame;

placing vegetation material in the container;

operatively joining the carbon dioxide vessel to the container through a conveyor and a size adjustable nozzle, whereby the carbon dioxide flash freezes the vegetation material in the container;

operatively joining an agitation motor to the apparatus frame, the agitation motor configured to agitate the apparatus frame, such that the container is forcibly manipulated, whereby the flash frozen vegetation material is agitated and a byproduct disengages from the flash frozen vegetation material; and selectively collecting the byproduct through at least one classifier.

17. The method of claim 16, wherein the carbon dioxide vessel further comprises a nitrogen.

18. The method of claim 16, wherein the size adjustable nozzle is disposed between the conveyor and the container, the size adjustable nozzle configured to regulate the flow of the carbon dioxide from the conveyor to the container, the size adjustable nozzle further configured to have adjustable dimensions.

19. The method of claim 16, wherein the byproduct of the vegetation material includes at least one member selected from the group consisting of: an oil, an herb, and pollen.

* * * * *